US007164356B1

(12) United States Patent
Zeitz

(10) Patent No.: US 7,164,356 B1
(45) Date of Patent: Jan. 16, 2007

(54) COMBINATION SECURITY BAR AND ALARM SYSTEM

(76) Inventor: Israel Zeitz, 1656 SE. Haverford St., Port St. Lucie, FL (US) 34983

( * ) Notice: Subject to any disclaimer, the term of this patent is extended or adjusted under 35 U.S.C. 154(b) by 0 days.

(21) Appl. No.: 11/356,809

(22) Filed: Feb. 21, 2006

(51) Int. Cl.
*G08B 13/08* (2006.01)

(52) U.S. Cl. ..... 340/546; 292/338; 292/339

(58) Field of Classification Search ..... 340/546; 292/338, 339
See application file for complete search history.

(56) References Cited

U.S. PATENT DOCUMENTS 4,607,253 A * 8/1986 Wooten et al. ..... 340/546
5,340,175 A * 8/1994 Wood ..... 292/339
5,392,026 A * 2/1995 Marik ..... 340/546

* cited by examiner

*Primary Examiner*—Jeffery Hofsass
*Assistant Examiner*—Samuel J Walk

(57) ABSTRACT

A battery operated, portable alarm device integrated with a telescoping security bar containing a triggering switch and a tilt sensitive switch, either of which will activate the alarm circuit when an intruder tries to enter a room through the door. A pressure switch, located on the top section of the security bar, which is positioned just under the doorknob shaft, will be pressed in as the door is slightly opened. The opening action, of the door, causes the security bar to rotate through an arc until the distance from the floor to the pressure switch has been shortened and forces the shaft of the doorknob to press against the pressure switch and activates the alarm. The intruder might try to defeat the pressure action of the doorknob, by sliding a thin piece of cardboard or other thin material under the door in an attempt to push the security bar base away from the door, causing the bar to fall. If tilting of the bar should occur, the tilt switch circuit, which is set between a specific tilt angle and the horizontal, will activate the alarm. In either case the alarm will continue to sound until it is turned off.

1 Claim, 5 Drawing Sheets

COMBINATION SECURITY BAR AND ALARM SYSTEM

BACKGROUND OF THE INVENTION

1. Field of the Invention

This invention relates to devices used in the security and warning alarm category. It is a security bar with an integrated portable alarm system. More specifically, the invention relates to portable, battery operated, continuous sounding alarm systems, integrated with a security bar that contains the triggering mechanisms.

2. Brief Description of the Prior Art

Security bars and various types of door alarm system have been patented. U.S. Pat. No. 6,513,778 B2 is of a similar type of security bar. It does not contain an integrated alarm system of any kind and is susceptible to having some thin material slid under the door and pressed against the base of the security bar to push the base away and have it fall to the ground. U.S. Pat. No. 5,988,710 is also of a similar type of security bar. It also does not contain an alarm system and sliding some type of thin material under the door, to push its base away, can also be used as in the previous invention mentioned above. A slight angular change of the present invention, from its ready position, will trigger the alarm. U.S. Pat. No. 3,921,564 is a portable alarm system. It is mechanical by nature and is not a security bar type of system. It does not impede the door from opening at all and is triggered only when the unit has fallen to the ground. U.S. Pat. No. 5,341,123 and U.S. Pat. No. 4,194,193, although battery operated and portable, do not have a locking circuit and will stop sounding the alarm when the door is closed, nor do they impede the door from being opened.

BRIEF DESCRIPTION OF THE DRAWINGS

FIG. 4*a* also shows the approximate layout of the electronic parts.

DETAILED DESCRIPTION OF THE DRAWINGS

Figure 1:
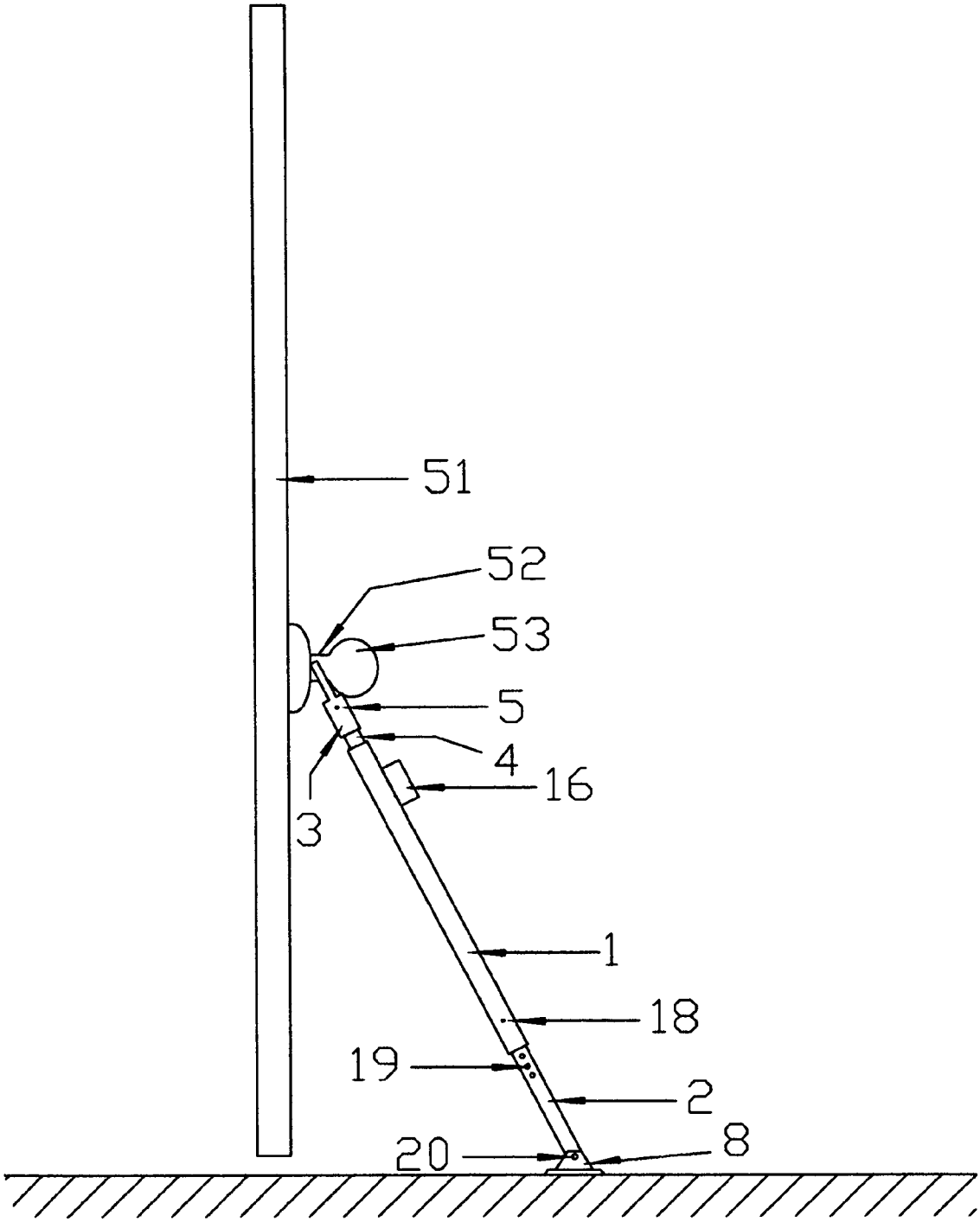
FIG. 1 shows the side view of the Rod_Larm. The total assembly is in the ready position. The top "Y" section placed against the doorknob shaft and the footplate at a distance from the door that creates approximately a sixty-degree angle between the rod and the floor.

Referring now to the drawings in detail, wherein like reference numerals indicate like elements throughout the different views.

FIG. 1 shows the side view of the Rod_Larm. The total assembly is in the ready position. The top "Y" section (3) placed against the doorknob shaft (52) and the footplate (8) at a distance from the door (51) that creates approximately a sixty-degree angle between the rod and the floor. The length of the Rod_Larm is adjusted by sliding the lower section (2) into the middle section (1) of the Rod_Larm and setting it in position by inserting a pin or bolt through hole (18), in the middle section, and through one of the holes (19), in the bottom section (2). When the door (51) starts to open, the doorknob shaft (52) of the doorknob (53) exerts a pressure against the "Y" section (3) which slides down insert rod (4) causing the bolt or pin, (5) in the "Y" section (3) to force the pressure switch (23) of FIG. 3, to activate the alarm system (explained in FIG. 5) inside the electronics box (16).

Figure 2:
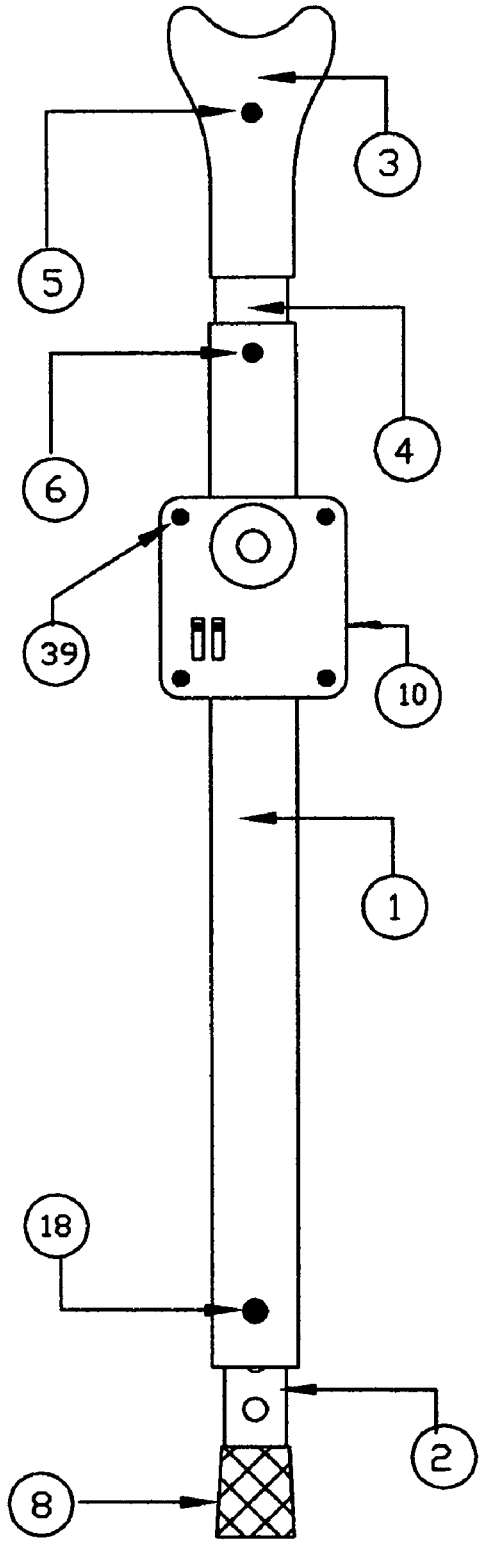
FIG. 2 shows the completely assembled front view of the Rod_Larm.
Figure 3:
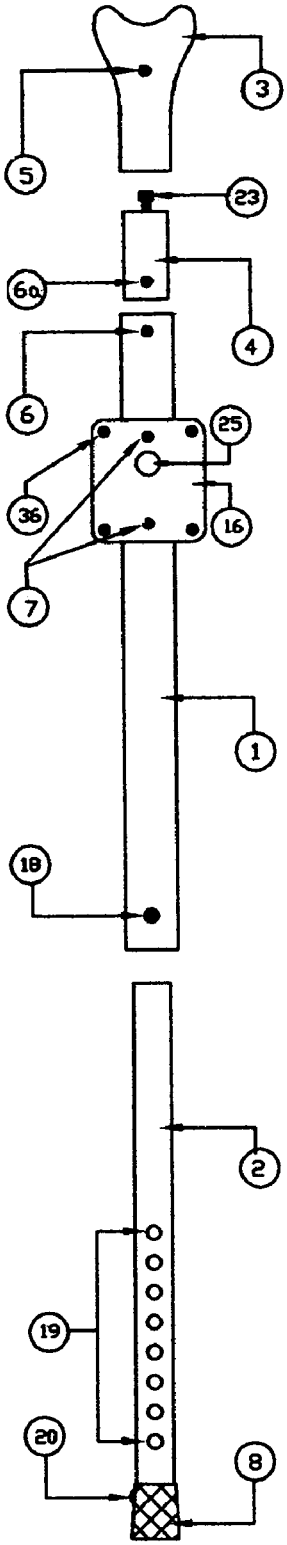
FIG. 3 is an exploded front view of the Rod_Larm of FIG. 2. The top "Y" section will slide over the middle section that holds the electronics box of the Rod_Larm. The bottom section slides into the middle section and is set to the length needed to attain the angle noted in the above brief description in FIG. 1. The base of the electronics box is affixed to the middle section of the Rod_Larm.

FIG. 2 shows the front view of the Rod_Larm in the assembled and ready mode. The pin or bolt through the hole (5) in the "Y" section (3) will press down on the activation switch (23) of FIG. 3, when door (51) of FIG. 1, starts to open. The activation switch (23), of FIG. 3, is secured in the insert rod (4) and the insert rod is secured with a pin or bolt through the hole (6) in the middle section (1). The footplate (8) is attached to the bottom section (2) of the Rod_Larm, with a pin or bolt (20) of FIG. 1, and does not have a separate adjustment. Alarm signaling system top cover (10) is attached to alarm signaling system base (16) of FIG. 1 with fasteners (39) shown in FIG. 4.

FIG. 3 is an exploded front view of the Rod_Larm of FIG. 2. When the "Y" section (3) slides over the insert rod (4), the pin or bolt (5) will come to rest against the top of the activation switch (23), which is secured in the insert section (4). The insert section (4) is secured to the middle section (1) with a pin or bolt through a hole (6), in the middle section (1) and a hole (6*a*) in the insert rod (4). The base of the electronics box (16) is secured with pins or bolts that pass through the holes (7) in electronics box base (16) and holes (not shown) in the middle section (1). The bottom section (2) slides into the middle section (1) and is set to the length needed to attain the angle of approximately 60 degrees made by the Rod_Larm and the floor, by inserting a pin or bolt through one of the holes (19) in the bottom section (2), and the hole (18) in the middle section (1). The footplate (8) is attached to the bottom section (2) of the Rod_Larm, with a pin or bolt, (20) of FIG. 1, and does not have a separate adjustment. The hole (25) through the base of the electronics box (16) and the middle section (1) is for the wires coming from the activation switch (23). The four posts (36) are used to secure the electronics box cover (10) of FIG. 4*b*.

Figure 4B:
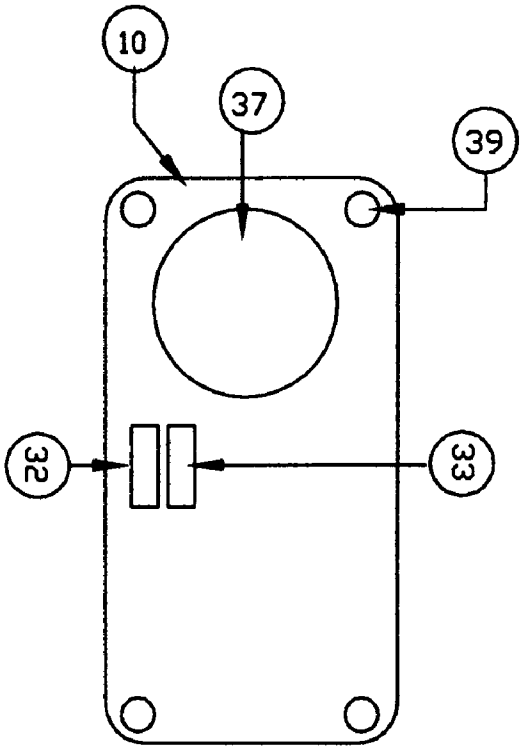
FIG. 4*b* shows the pictorial view of the cover of the electronics box with any electronic equipment mounted in their respective positions, excluding the remote pressure switch.
Figure 4A:
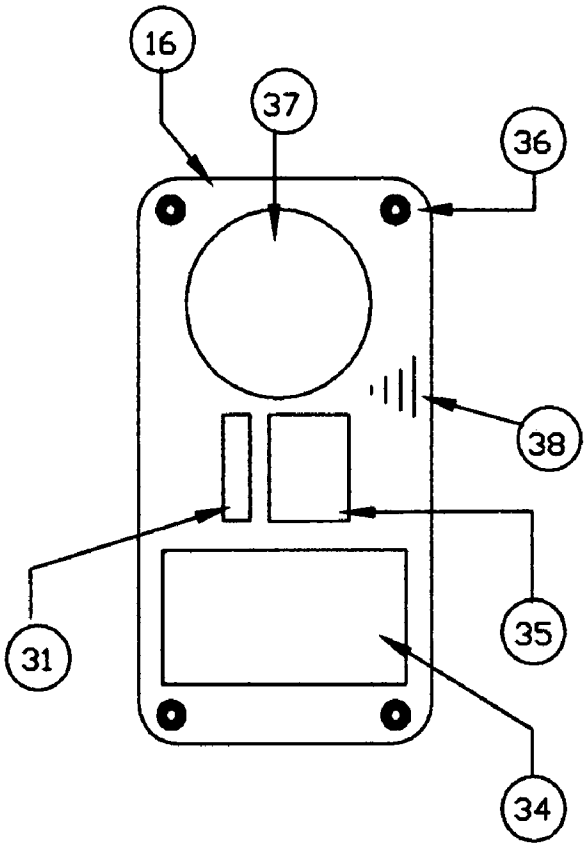
FIG. 4*a* shows the pictorial view of the electronics compartment, with the cover removed and excluding the remote pressure switch.

FIG. 4*a* is a pictorial view of the electronics box base (16), excluding the remote activation switch (23) FIG. 3, and the electronics parts mounted to the electronics box cover (10), shown in FIG. 4*b*. The approximate placement of the electronic parts on the electronics box base (16) shows the battery (34), the tilt switch (31), the single pole, normally open, relay (35), the grounding strip (38), the speaker, horn or buzzer (37) and the four posts (36) used to secure the cover (10) of FIG. 4*b*.

FIG. 4*b* is a pictorial view of the electronics box cover (10), excluding the remote activation switch (23) FIG. 3, showing the system on/off switch (32), the tilt override switch (33), the speaker, horn or buzzer (37) and the four holes (39) to secure the electronics box cover (10) to the electronics box base (16) FIG. 4*a*.

Figure 5:
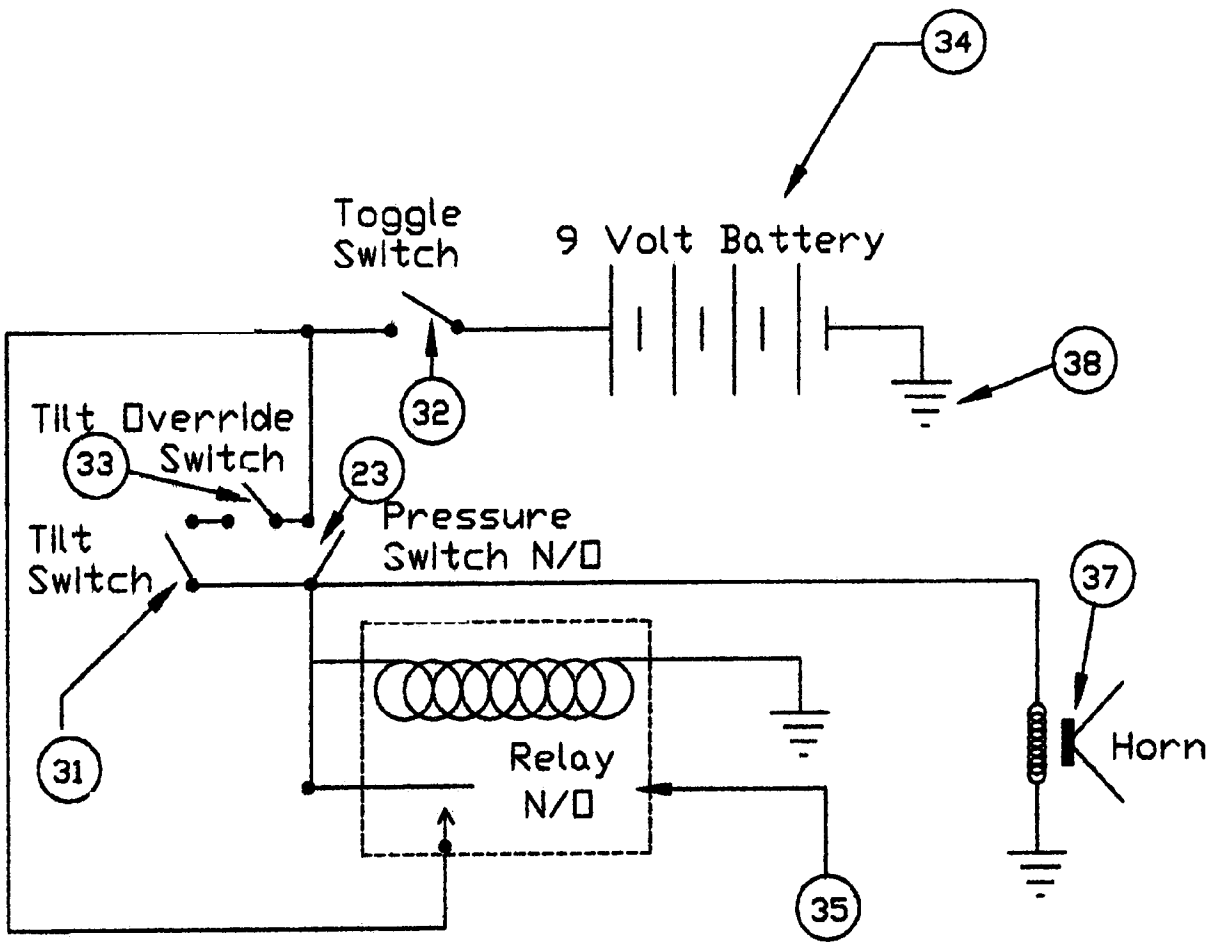
FIG. 5 is a schematic drawing of the electronic equipment in FIGS. 4*a* and 4*b*, and includes all the electronic components including the remote pressure switch.

FIG. 5 is a schematic drawing of the electronic equipment in FIG. 4*a*, FIG. 4*b* and the remote activation switch (23) FIG. 3. When the system ON/OFF switch (32) is in the on or closed position, the Rod_Larm is armed and ready. When the system ON/OFF switch (32) is in the on or closed position, and a pressure triggers the activation switch (23), an electric current, from the battery (34), closes the single pole normally open relay (35), through the ground strip (38), and causes the relay contact arm (40) to touch the contact (41) and thus lock the relay (35) into a closed condition. The result of this action causes current to flow to the speaker, horn or buzzer (37). The speaker, horn or buzzer (37) will continue to sound until the system ON/Off switch (32) has been moved to the OFF or open position. If the tilt override switch (33) is in the on or closed position, tilting the Rod_Larm past a certain pre-set position will activate the system, via the tilt switch (31), and continuously sound the alarming device (37), as explained above, until the system ON/OFF switch (32) is moved to the OFF or open position.

Various other modifications can be made in detail of the various embodiments of the apparatus and method of the present invention, all within the scope and spirit of the invention and defined by the claims.

I claim:

1. An alarm system comprised of a signaling device, mounted to a security bar, activated by a tilt sensitive switch, which completes an electrical circuit when a base of the security bar has been pushed away from a door a specific distance and reaches a preset angle from a vertical, sounding the alarm, until turned off.

* * * * *